US006906629B2

(12) United States Patent
Frederick

(10) Patent No.: US 6,906,629 B2
(45) Date of Patent: Jun. 14, 2005

(54) DIFFERENTIALLY COHERENT COMBINING FOR ELECTRONIC ARTICLE SURVEILLANCE SYSTEMS

(75) Inventor: Thomas J. Frederick, Coconut Creek, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 693 days.

(21) Appl. No.: 10/071,412

(22) Filed: Feb. 8, 2002

(65) Prior Publication Data

US 2004/0145478 A1 Jul. 29, 2004

Related U.S. Application Data

(60) Provisional application No. 60/267,886, filed on Feb. 8, 2001.

(51) Int. Cl.[7] ..... G08B 13/14

(52) U.S. Cl. ..... 340/572.1; 340/568.1; 340/572.2; 340/572.4

(58) Field of Search ..... 340/551, 561, 340/567, 568.1, 572.1, 572.4, 572.2, 572.5, 10.1, 10.51, 825.54; 343/742; 324/201, 260

(56) References Cited

U.S. PATENT DOCUMENTS

| | | | | |
|---|---|---|---|---|
| 4,510,489 A | | 4/1985 | Anderson et al. | 340/572 |
| 5,239,696 A | * | 8/1993 | Balch et al. | 455/127.1 |
| 5,387,900 A | | 2/1995 | Plonsky et al. | 340/572 |
| 5,748,086 A | | 5/1998 | Bettine et al. | 340/572 |
| 5,874,896 A | * | 2/1999 | Lowe et al. | 340/572.1 |
| 5,942,935 A | * | 8/1999 | Okanobu | 327/553 |
| 6,633,550 B1 | * | 10/2003 | Gardenfors et al. | 370/280 |
| 6,838,989 B1 | * | 1/2005 | Mays et al. | 340/572.1 |

* cited by examiner

*Primary Examiner*—Brent A. Swarthout

(57) ABSTRACT

Conventional EAS systems, such as ULTRA*MAX, use noncoherent detection and a highly nonlinear post detection combining algorithm. It is well known that using the phase information that is present in the received signal has advantages in detection performance. This is difficult to do in conventional ULTRA*MAX receiver because of the combination of a narrow signal bandwidth and short receive window duration. A method to incorporate signal phase into the detector by differential coherent combining is provided, which significantly improves processing gain that was not previously obtainable.

8 Claims, 9 Drawing Sheets

DIFFERENTIALLY COHERENT COMBINING FOR ELECTRONIC ARTICLE SURVEILLANCE SYSTEMS

CROSS REFERENCES TO RELATED APPLICATIONS

This application claims the benefit of U.S. Provisional Application No. 60/267,886, filed Feb. 8, 2001.

STATEMENT REGARDING FEDERALLY SPONSORED RESEARCH OR DEVELOPMENT

Not Applicable

BACKGROUND OF THE INVENTION

1. Field of the Invention

This invention relates to electronic article surveillance receivers, and more particularly, to signal processing and detection techniques for an electronic article surveillance receiver.

2. Description of the Related Art

Electronic article surveillance (EAS) systems, such as disclosed in U.S. Pat. No. 4,510,489, transmit an electromagnetic signal into an interrogation zone. Magnetomechanical EAS tags in the interrogation zone respond to the transmitted signal with a response signal that is detected by a corresponding EAS receiver. Pulsed magnetomechanical EAS systems have receivers, such as ULTRA*MAX receivers sold by Sensormatic Electronics Corporation, Boca Raton, Fla., that utilize noncoherent detection and a highly nonlinear post detection combining algorithm in processing the received signals. To improve processing gain, phase information present in the received signal can be utilized in detection.

BRIEF SUMMARY OF THE INVENTION

A system and method for differential coherent combining of received signals in an electronic article surveillance receiver is provided. The systems includes receiving a receive signal including a first component of an electronic article surveillance tag response and a second component of noise. Next the receive signal is filtered with a plurality of filters each having a preselected bandwidth and a preselected center frequency. The output of each of said plurality of filters are sampled to form a plurality of filtered samples. Each of the plurality of filtered samples are combined by diversity averaging. A quadratic detector detects each of the plurality of filtered samples by squaring the diversity combined samples and summing to arrive at a differentially coherent combined signal.

The system may further compare the differentially coherent combined signal to a preselected threshold and provide an output signal associated with said comparison. The output signal may trigger an alarm or other selected reaction.

Objectives, advantages, and applications of the present invention will be made apparent by the following detailed description of embodiments of the invention.

DETAILED DESCRIPTION OF THE INVENTION

Figure 1:
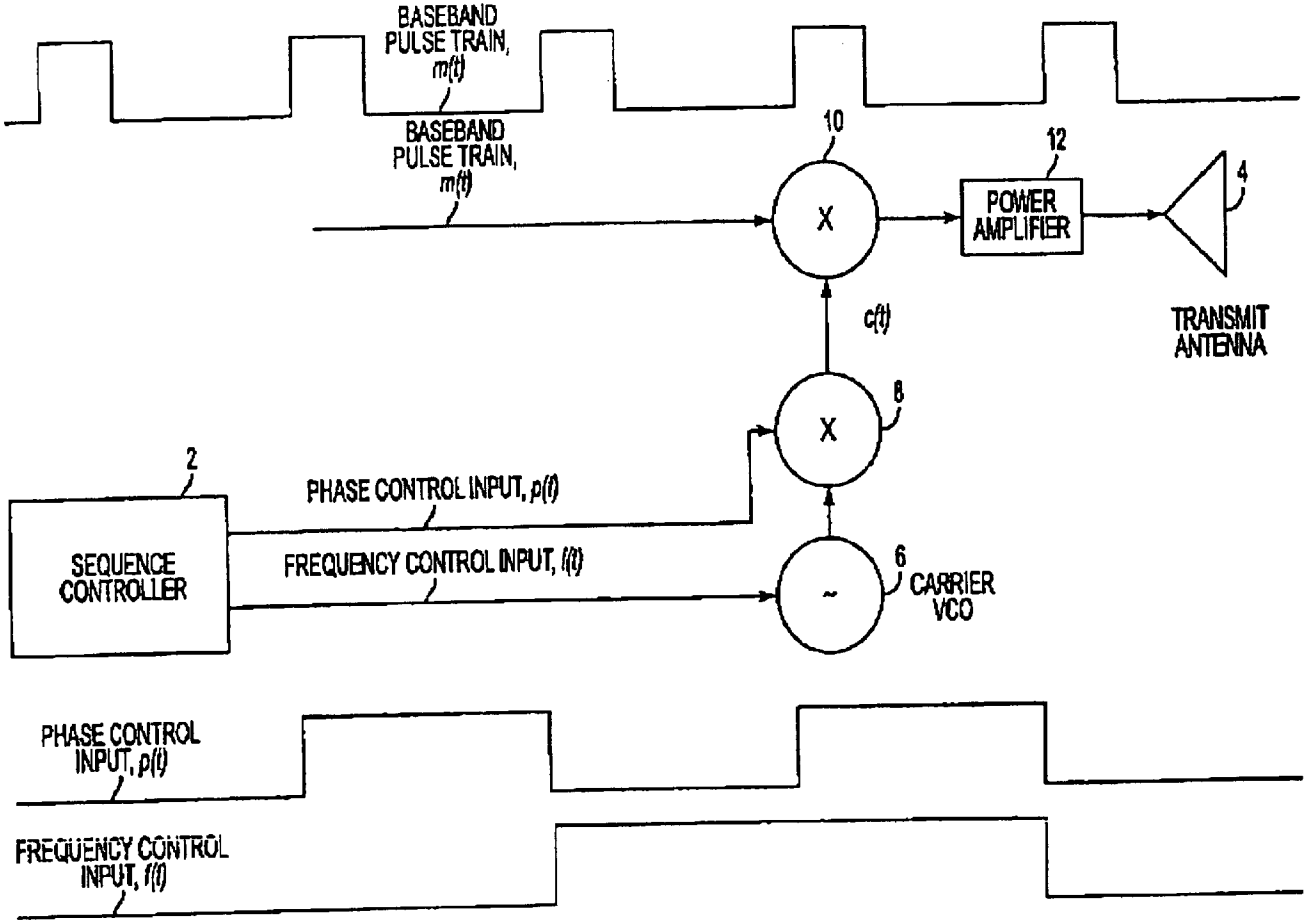
FIG. 1 is a block diagram of a conventional EAS transmitter.

Referring to FIG. 1, a conventional pulsed EAS transmitter is illustrated, such as that sold under the name ULTRA*MAX by Sensormatic Electronics Corporation. Sequence Controller 2 is typically a state machine that executes in software. It is responsible for frequency hopping and phase flipping the transmit signal so that tags of various center frequencies and physical orientations are adequately excited by the transmitter. The frequency control signal f(t) takes on one of three values. When f(t)=0, then the nominal center frequency, such as 58,000 Hz, is transmitted. When f(t)=1, then the high frequency, such as 58,200 Hz is transmitted. If f(t)=−1, the low frequency, such as 57,800 Hz is transmitted. The phase control signal p(t) takes on one of two values, p(t)=1 or p(t)=−1. This controls the polarity of the transmit antennas 4, either aiding or opposing. The carrier signal is typically a phase locked loop based oscillator that includes a voltage controlled oscillator 6 that is modulated by the phase and frequency control inputs 8. The carrier signal c(t) can be denoted:

$$C(t)=p(t)\cdot\sin(2\cdot\pi\cdot(f_c+f(t)\cdot)\cdot t+\theta),$$

where θ is an arbitrary phase angle that depends on the hardware. The carrier signal is combined 10 with a baseband pulse train m(t) before being amplified 12

The receive signal is processed by an analog front end, sampled by an analog to digital converter (ADC), and compared to a threshold. The threshold is set by estimating the noise floor of the receiver, then determining some suitable signal to noise ratio to achieve a good trade off between detection probability, $P_{det}$, and false alarm probability, $P_{fa}$. The sequence controller 2 would typically produce frequency and phase control signals as shown in FIG. 1. When a signal is initially detected based on the threshold test (known as an "initial hit"), the sequence controller 2 "locks" the transmitter phase and frequency values for a "validation sequence". The validation sequence is usually around six transmit bursts long. During this validation sequence the system basically verifies that the signal continues to be above the threshold.

Figure 2:
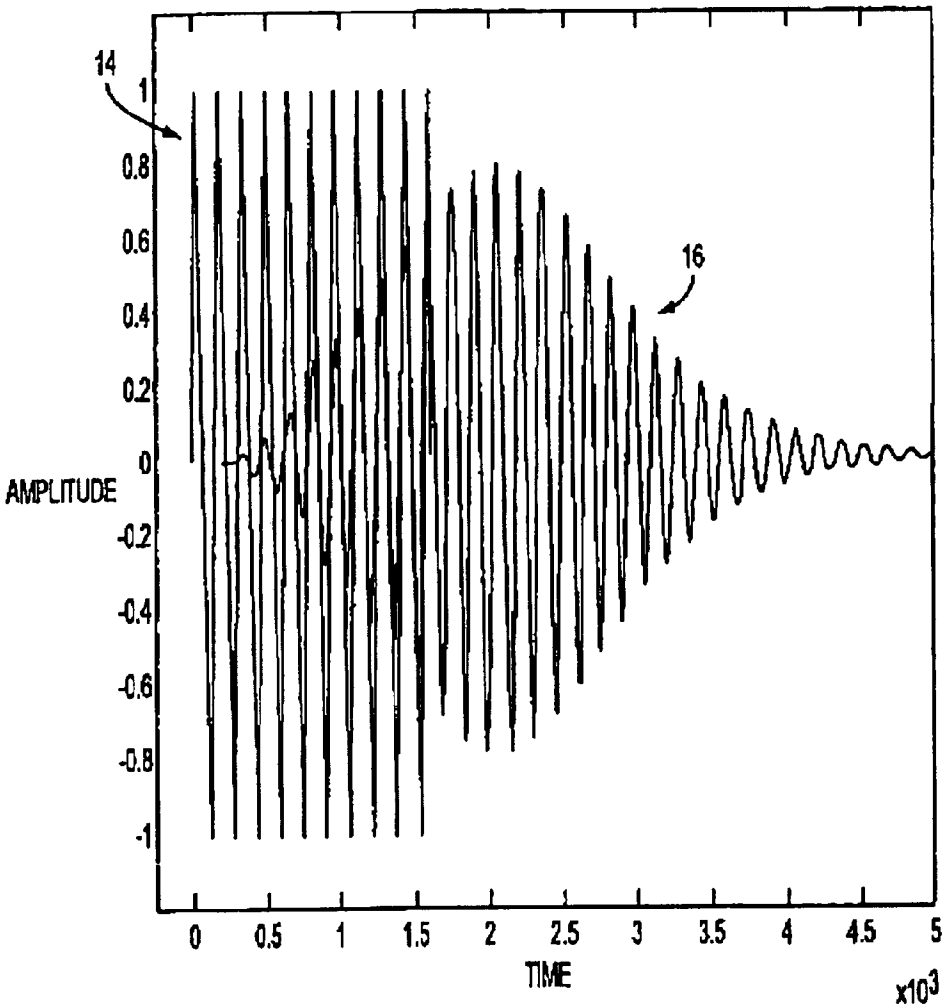
FIG. 2 is a plot of a transmit signal and tag response signal.

There are two modes of operation for a magnetomechanical tag, such as an ULTRA*MAX tag as disclosed in the '489 patent, linear and nonlinear. For the linear model, the tag behaves as a simple second order resonant filter with impulse response:

$$h(t)=A_o\cdot e^{-\alpha t}\cdot\sin(2\cdot\pi\cdot f_n\cdot t+\theta)$$

where $A_o$ is the amplitude of the tag response, $f_n$ is the natural frequency of the tag, and α is the exponential damping coefficient of the tag. FIG. 2, shows a plot of a transmit signal 14 and the tag response signal 16 when the tag operates linearly.

The nonlinear model is more closely coupled to the mechanics of the tag itself. The tag becomes nonlinear when it is overdriven by the transmitter. In this case, the resonator (s) within the cavity vibrate so hard that they begin to bounce off the interior walls of the cavity. In this mode, the behavior is analogous to the ball inside the pinball machine. Very small changes in initial conditions of the resonator result in large changes in the phase and amplitude of the final tag ring down. This is an example of the nonlinear dynamics known as chaos. Although this nonlinear response will be mentioned briefly, the present invention is primarily concerned with detection of the tag when it is in the region of linear behavior. Thus, unless specifically called out, the remainder of this description refers to tag response that is linear.

The signal from the receive antenna when a tag is present is the sum of the tag's natural response to the transmit signal plus the additive noise due to the environment. ULTRA*MAX systems operating around 60000 Hz preside in a low frequency atmospheric noise environment. The statistical characteristics of atmospheric noise in this region is close to Gaussian, but somewhat more impulsive (i.e., a symmetric $\alpha$-stable distribution with characteristic exponent near, but less than, 2.0).

In addition to atmospheric noise, the 60000 hertz spectrum is filled with man-made noise sources in a typical office/retail environment. These man-made sources are predominantly narrowband, and almost always very non-Gaussian. However, when many of these sources are combined with no single dominant source, the sum approaches a normal distribution (due to the Central Limit Theorem).

The classical assumption of detection in additive white Gaussian noise is used herein. The "white" portion of this assumption is reasonable since the receiver input bandwidth of 3000 to 5000 hertz is much larger than the signal bandwidth. The Gaussian assumption is justified as follows.

Where atmospheric noise dominates, the distribution is known to be close to Gaussian. Likewise, where there are a large number of independent interference sources the distribution is close to Gaussian due to the Central Limit Theorem. If the impulsiveness of the low frequency atmospheric noise were taken into account, then the optimum detector could be shown to be a matched filter preceded by a memoryless nonlinearity. The optimum nonlinearity can be derived using the concept of influence functions. Although this is generally very untractable, there are several simple nonlinearities that come close to it in performance. To design a robust detector we need to include some form of nonlinearity. When there is a small number of dominant noise sources we include other filtering to deal with these. For example, narrow band jamming is removed by notch filters or a reference based least means square canceller. After these noise sources have been filtered out, the remaining noise is close to Gaussian. Although many real installations may deviate from the Gaussian model, it provides a controlled, objective set of conditions with which to compare various detection techniques.

Figure 3:
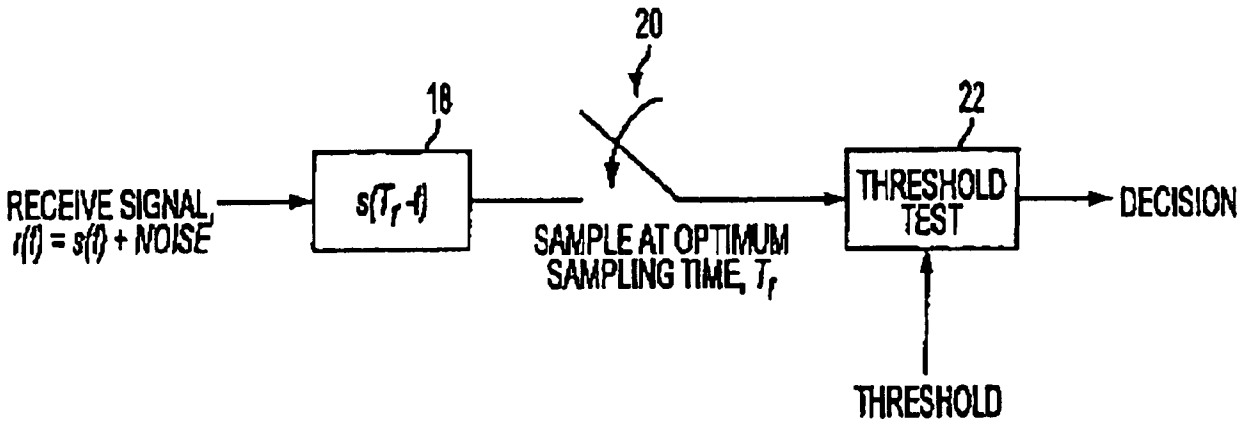
FIG. 3 is a block diagram of a conventional matched filter detector.

Referring to FIG. 3, when the signal of interest is completely known a matched filter is the optimum detector. In our case, say we knew the resonant frequency of the tag and its precise phase angle when ringing down. The signal we're trying to detect is $$s(t)=A\cdot e^{-\alpha\cdot t}\cdot\sin(2\cdot\pi\cdot t+\theta).$$

Then the matched filter is simply the time reversed (and delayed for causality) signal, $s(T_r-t)$ at 18. The matched filter output is sampled 20 at the end of the receive window, $T_r$, and compared to the threshold 22. A decision signal can be sent depending on the results of the comparison to the threshold. The decision can be a signal to sound an alarm or to take some other action. Note that we do not have to know the amplitude, A. This is because the matched filter is a "uniformly most powerful test" with regard to this parameter. This comment applies to all the variations of matched filters discussed below.

Figure 4:
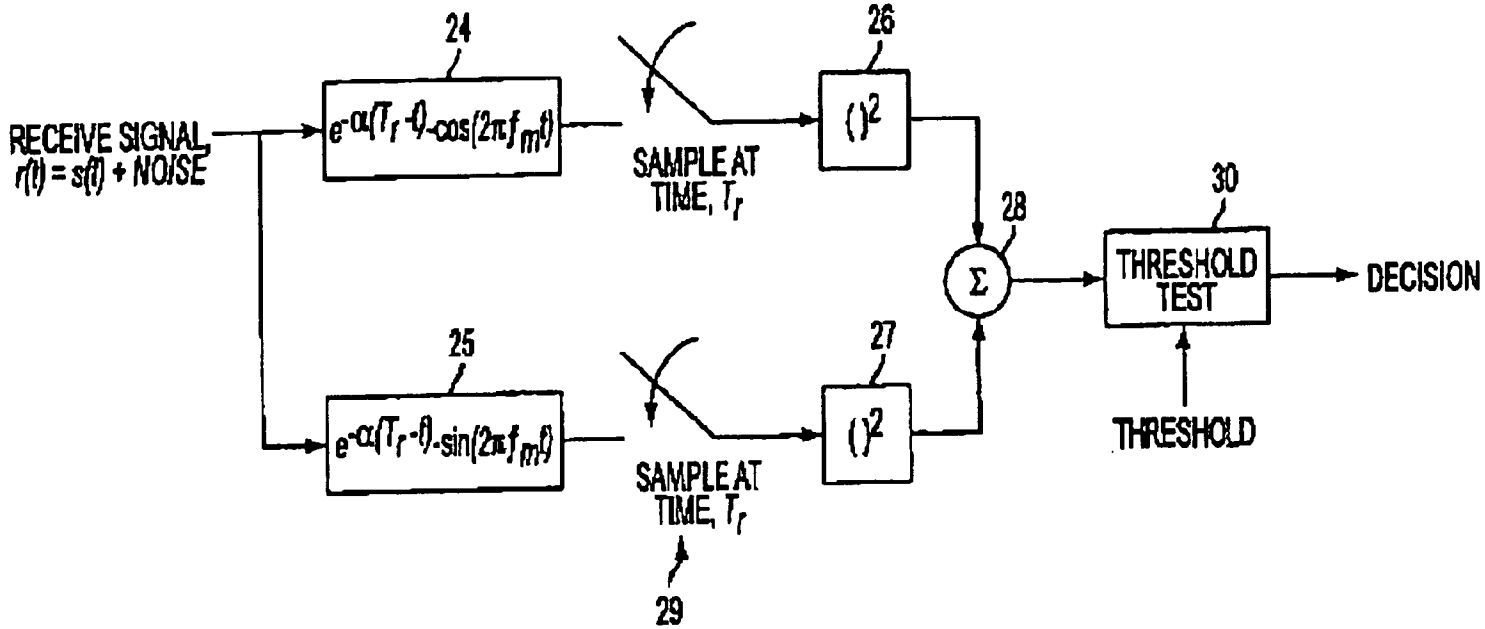
FIG. 4 is a block diagram of a conventional quadrature matched filter detector.

Referring to FIG. 4, when the signal of interest is completely known except for its phase $\theta$, then the optimum detector is the quadrature matched filter (QMF). QMF is also known as noncoherent detection, since the receiver is not phase coherent with the received signal. On the other hand, the matched filter is a coherent detector, since the phase of the receiver is coherent with the received signal. The receive signal r(t) which includes noise and the desired signal s(t) is filtered by $s(T_r-t)$ at 24 as in the matched filter, and again slightly shifted in phase by $\pi/2$ at 25. The outputs of 24 and 25 are sampled at 29, squared at 26 and 27, respectively, combined at 28, and compared to the threshold 30.

Figure 5:
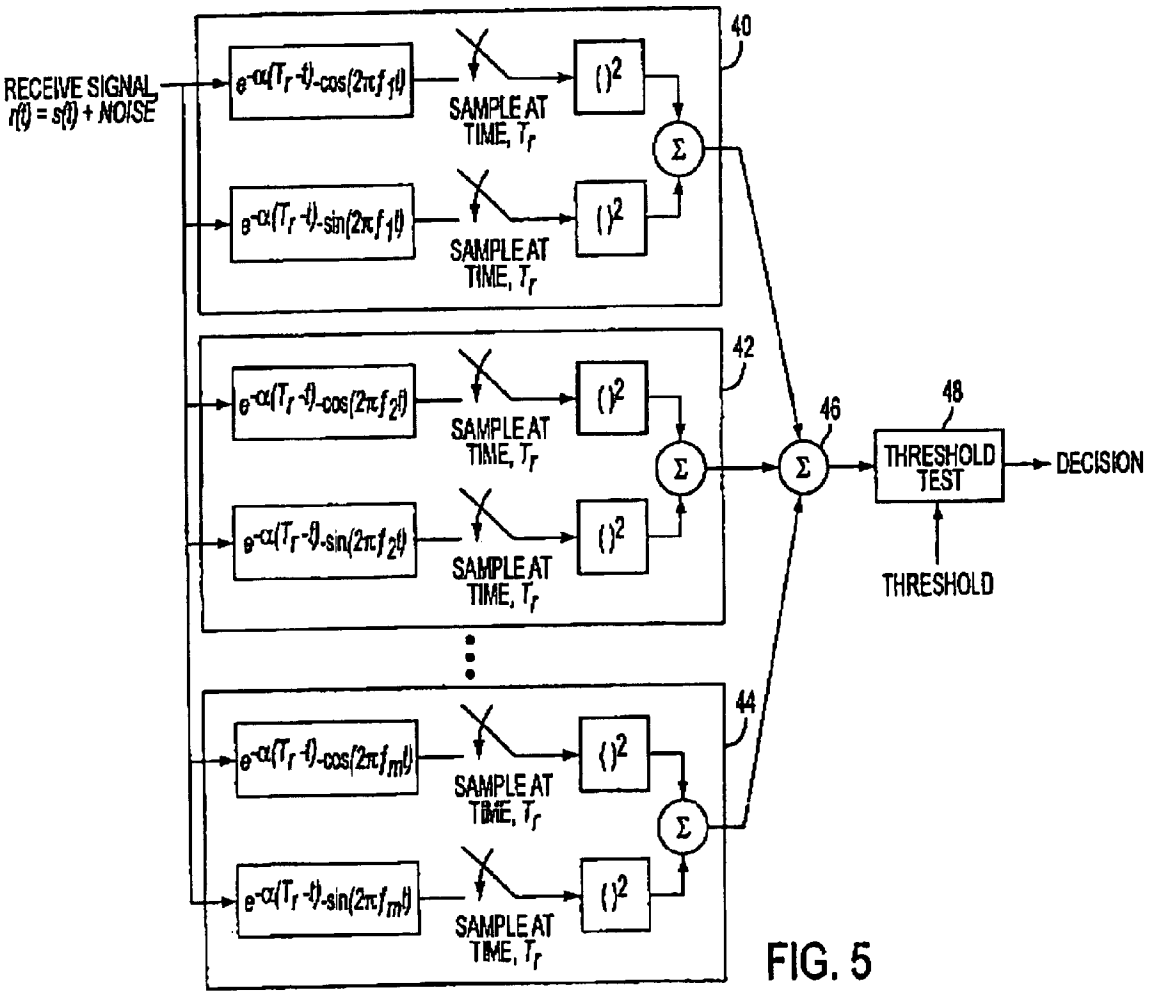
FIG. 5 is a block diagram of an implementation of a bank the quadrature matched filters shown in FIG. 4.

Referring to FIG. 5, when the signal of interest is completely known except for its frequency $f_n$ and phase $\theta$, then the optimum detector is a bank of quadrature matched filters (QMFB). A quadrature matched filter bank can be implemented as a plurality of quadrature matched filters 40, 42, and 44, which correlate to quadrature matched filters with center frequencies of $f_1$, $f_2$ through $f_m$, respectively. The outputs of the quadrature matched filters are summed at 46 and compared to a threshold at 48.

Figure 6:
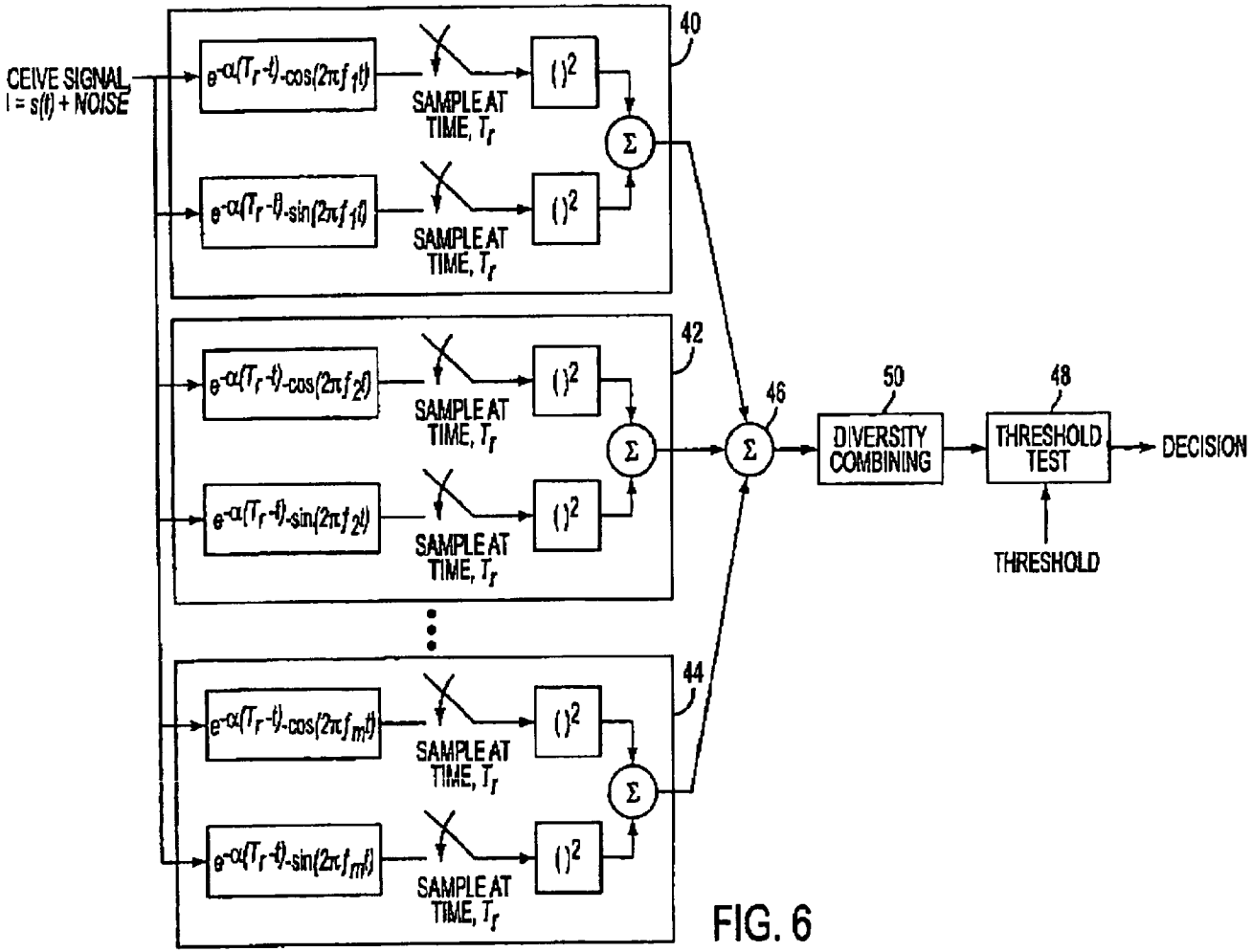
FIG. 6 is a block diagram of the bank of filters of FIG. 5 with conventional initial hit/validation combining.

Referring to FIG. 6, often the signal to noise ratio does not allow for the desired performance, i.e., low enough false alarm probability $P_{fa}$ with high enough detection probability $P_{det}$. In this case one form or another of diversity may be available to improve the SNR, thereby reaching performance goals. Systems such as ULTRA*MAX use time diversity, averaging over multiple receive windows to reduce the effects of noise. The textbook method for doing this with a quadrature matched filter bank is to average the QMFB output over many receive windows and perform a threshold test. For white Gaussian noise, the noise in different receive windows is uncorrelated and therefore its effects can be reduced by averaging. Asymptotically, the noise can be reduced 1.5 dB for every doubling of the number of receive windows averaged. However, using coherent detection 3.0 dB of noise reduction can be achieved for every doubling of the number of receive windows averaged. This is a significant difference and is an important feature of the present invention.

Present EAS systems using nonlinear post detection combining is illustrated by the initial hit/validation diversity combiner 50. The resulting detection statistic is compared to an estimate of the noise floor. If a signal to noise ratio criteria is met the system will go into validation. At this point the sequence controller 2, shown in FIG. 1, locks to the transmitter configuration which passed the initial hit threshold test. The transmitter does a number of additional bursts N, typically about six. If all N of the receive samples pass the threshold test, then the system alarms.

This validation sequence is in effect a form of post detection combining, albeit a very nonlinear one. It can be referred to it as a "voting" combiner, where a certain percentage of the threshold tests must pass, for example, this may require 100% pass, for a unanimous decision.

Figure 7:
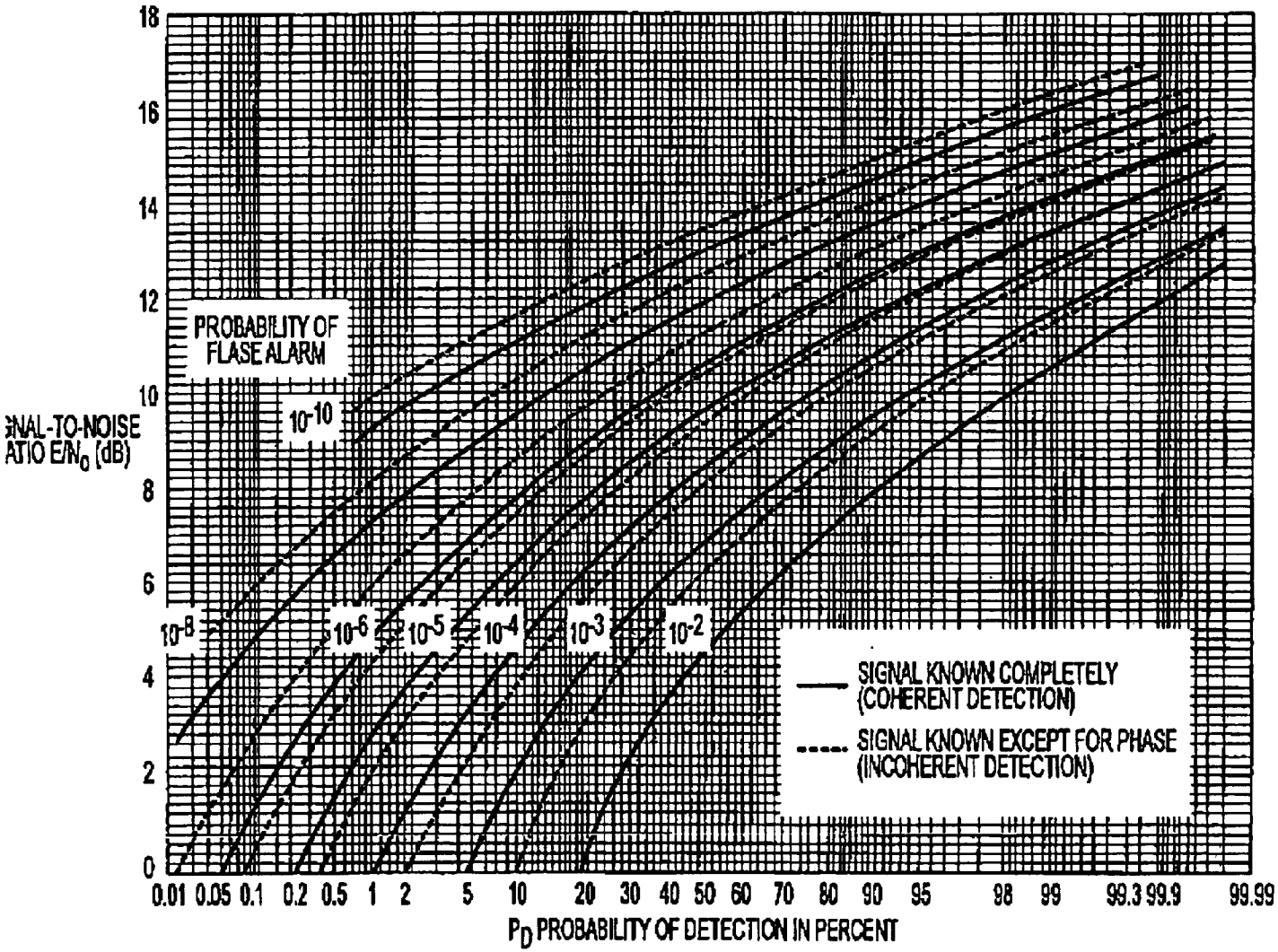
FIG. 7 is a plot of receiver operating characteristics of coherent and noncoherent detection.

To analyze the performance of the conventional detection scheme, specifically the noncoherent detection with "initial hit/validation" type post detection combining, we assume a Neyman-Pearson type criteria, i.e., we choose an acceptable level for the false alarm rate $P_{fa}$, then determine our probability of detection $P_{det}$ verses SNR. Receiver operating characteristics for coherent and noncoherent detection, as well known in the art, is shown in FIG. 7.

First, the probability of passing the threshold test on a single receive test statistic when in fact there is no tag signal present is denoted as $P_{fv}$, the probability of false validation. A validation sequence would follow in which all N test statistics would have to be above the threshold. Using the independence of the receive samples we have $$P_{fa}=P_{fv}^{(N+1)}.$$

Likewise, $P_{ih}$ is the probability of passing the threshold test when there is in fact a tag signal present. Again using independence, the probability of detection is $$P_{det}=P_{ih}^{(N+1)}.$$

Now, we choose N=3 and $P_{fa}=10^{-8}$. Solving, we get $P_{fv}=10^{-2}$. Assume that the threshold is set for 12 dB. Then using the curves in FIG. 7 for noncoherent detection, $P_{ih}=0.992$. Then calculating $P_{det}=0.968$.

Notice that if only one receive sample at $P_{fa}=10^{-8}$ and 12 dB SNR, then $P_{det}=0.35$. To achieve $P_{det}=0.968$ we would have needed 14.8 dB SNR. This difference, 14.8 dB−12 dB=2.8 dB, represents the processing gain due to the "unanimous vote" combining scheme used in the conventional receiver.

It is apparent that a great deal of information is being lost by ignoring the signal's phase. The data is reduced beyond the point of a sufficient statistic (we no longer satisfy the sufficiency requirement fundamental to detection theory). The present invention recovers this lost information. The result is based on the linearity of the tag model, and transposing the order of linear post detection combining and noncoherent detection.

Since the tag signal is linear, then given a set of initial conditions and parameters $\alpha$, and $f_n$, its response is determined. For any given tag in a given orientation, its parameters are fixed. Therefore, if the transmitter function is the same for every transmit burst, then the tag's initial conditions when the transmitter shuts off will be the same, and the tag's natural response will be the same. That is, the tag signal's amplitude A and phase $\theta$ will be fixed.

This turns out to be true over short durations of time even when the tag is in motion. In other words, when the tag passes through the interrogation zone at one meter per second in a set orientation, its phase changes very little. Its amplitude changes relative to the amount of transmitter field it is excited by. However, given that the transmitter repetition rate is about 90 hertz (one burst every 11 milliseconds) the tag can only move 11 millimeters in this time. Over short periods of time the tag's amplitude is relatively stable.

The fact that the tag signal's amplitude and phase are approximately equal from one receive window to the next is valuable information. The exact value of the signal's phase is not known, but we know that the differential of the phase angle is nearly zero. To take advantage of this, diversity combining can be implemented in front of the quadrature detector. This takes advantage of the 3.0 dB per doubling processing gain of coherent combining without actually knowing the signal's phase.

Note that to accomplish this processing gain, the system must do away with the concepts of initial hit and validation. Instead, the sequence controller portion of the transmitter must now send N identical transmit bursts in a row prior to any decision being made by the detector. This is analogous to the fixed length dwell concept used in radar systems.

Figure 8:
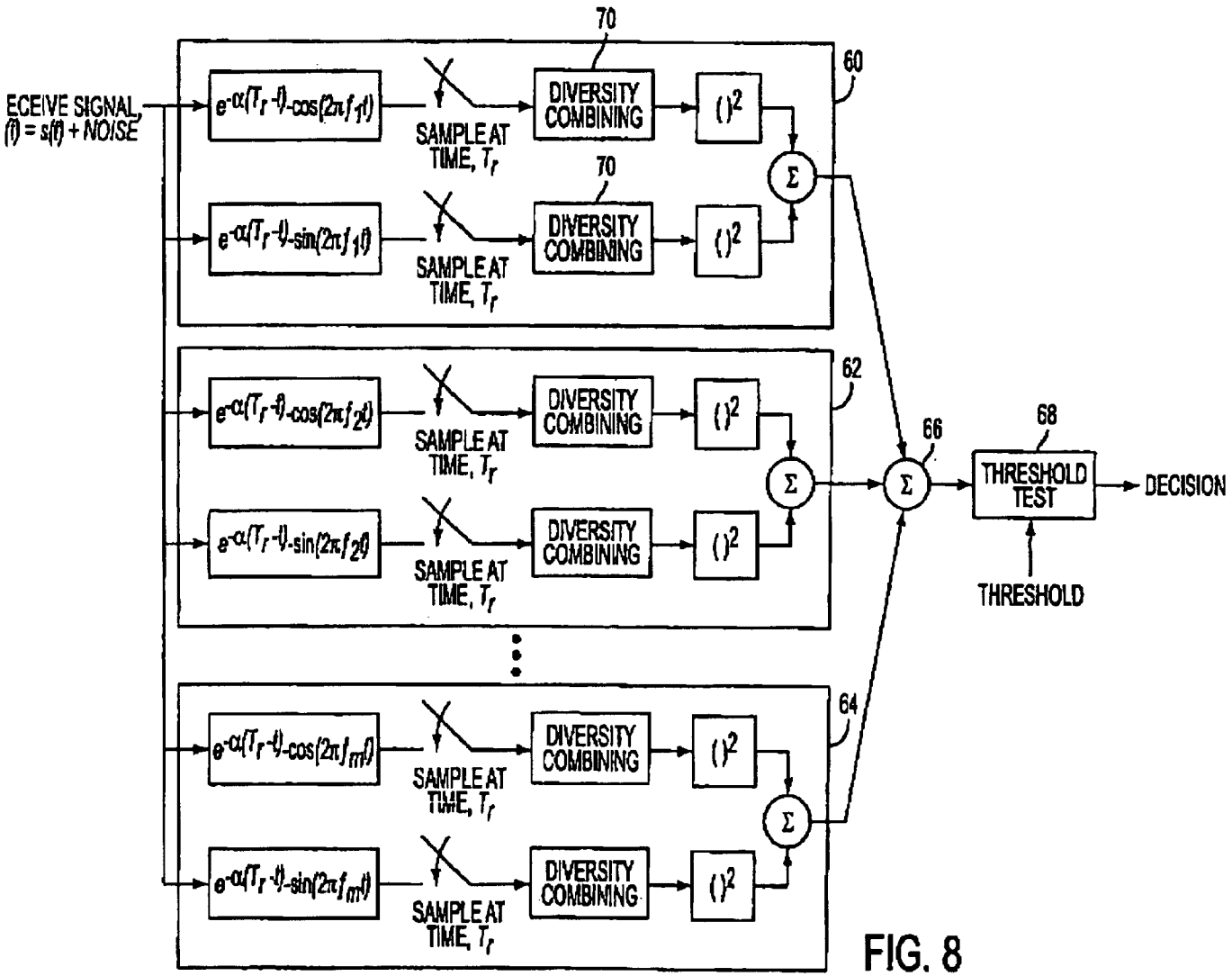
FIG. 8 is a block diagram illustrating the inventive detector using differential coherent combining.

Referring to FIG. 8, the present invention includes a plurality of quadrature matched filters 60, 62, and 64, which correlate to quadrature matched filters with center frequencies of $f_1$, $f_2$ through $f_m$, respectively, the outputs of which are summed at 66 and compared to a threshold at 68. However, unlike conventional post detection diversity combining, or averaging, as shown in FIG. 6, the diversity combining 70 occurs prior to detection in the present invention. In implementation of the present invention, the received signal r(t) must have the transmitter's phase variation removed as fully described hereinbelow.

Figure 9:
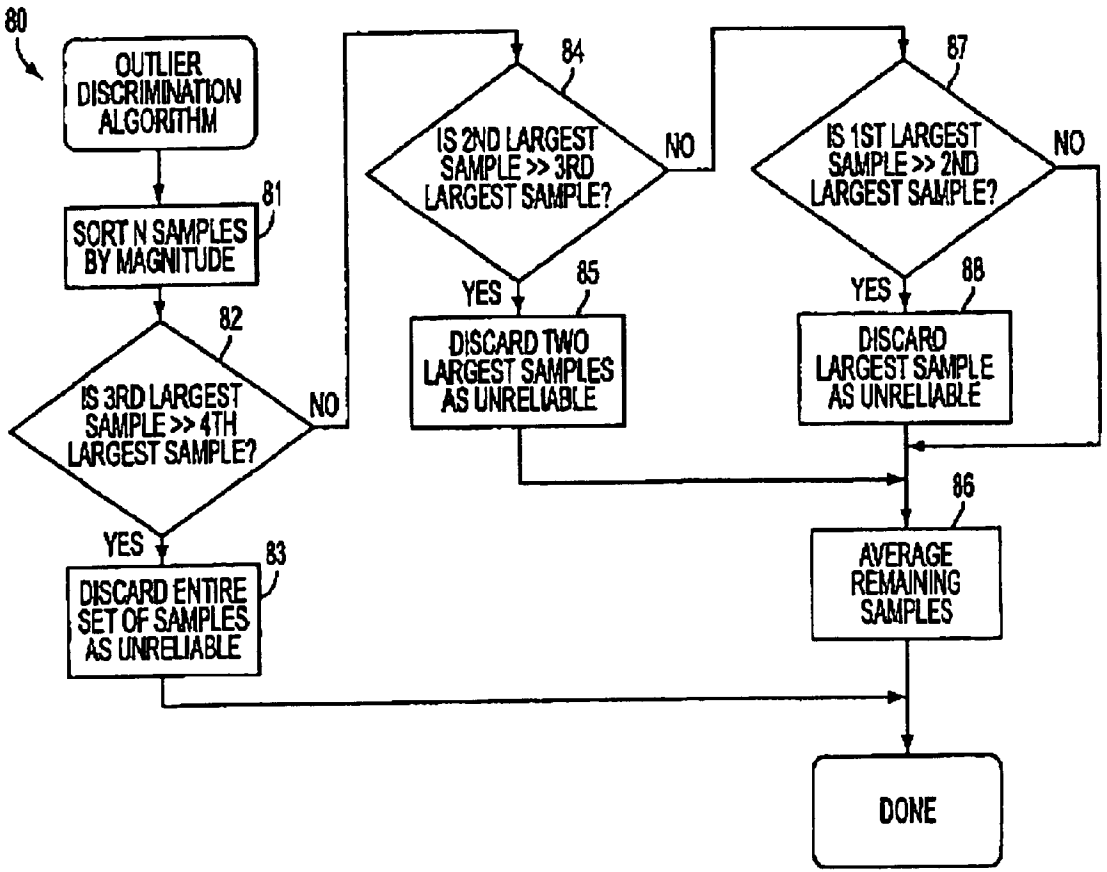
FIG. 9 is flow chart of the outlier discrimination algorithm.

Referring to FIG. 9, the validation sequence type diversity combining is nonlinear to deal effectively with impulsive noise. Likewise, the differentially coherent combiner must contain some nonlinearity to minimize false alarming on impulse noise. Many nonlinear filters would work such as median filters, alpha-trimmed filters, and the like. However, to maximize processing gain as little data as possible should be discarded. To accomplish this, the current implementation of the differentially coherent combiner includes an outlier detection algorithm 80 which simply identifies whether all N outputs from the filter are reasonably close to one another. If there are a few outliers, they are discarded prior to averaging. If there are no outliers, none are discarded. If there are too many outliers (the spread of samples is too high), then the whole set of data is discarded as unreliable.

The outlier detection algorithm 80 can be implemented as follows. First, N samples are sorted by magnitude at 81. If the $3^{rd}$ largest sample is much greater than the $4^{th}$ largest at 82, the entire set of samples is discarded as unreliable at 83. Otherwise, if the $2^{nd}$ largest sample is much greater than the $3^{rd}$ largest sample at 84, the two largest samples are discarded as unreliable at 85, and the remaining samples are averaged at 86. Otherwise, if the $1^{st}$ largest sample is much greater than the $2^{nd}$ sample at 87, the largest sample is discarded as unreliable at 88 and the remaining samples are averaged at 86. Otherwise, all of the remaining samples are averaged at 86.

To implement the inventive "differentially coherent combining" in an EAS receiver, the initial conditions on the tag signal due to the transmitter must be constant. A simple way to do this is to implement a harmonic transmitter. Instead of having a free running transmit local oscillator 6, as shown in FIG. 1, a fixed burst waveform must be transmitted every time. One way to implement this with a linear transmitter would be to have a transmit waveform stored for each frequency: low, nominal, and high. When it is time to send a transmit burst, the sequence controller selects which one to send to drive the transmit amplifier.

When using a switching amplifier, a fixed crystal as the reference to a fractional divider to generate the 2-x clock frequency for the switching amplifier can be used. The circuitry keeps track of how many cycles are sent out. When the correct number of transmit carrier cycles are sent out, the transmitter is shut off. Care must be taken in the circuitry so that the transmitter starts and ends the same with every transmit burst.

When a transmit pulse train of identical bursts is analyzed spectrally, it turns out that the only signal energy appears at harmonics of the pulse repetition rate, e.g., 90 hertz. Thus, even though the transmit energy is centered at 58000 hertz, for example, an infinite pulse train would have zero energy at 58000 hertz. Indeed, the combiner averaging 70, illustrated in FIG. 8, can be viewed as a comb filter matched to 90 hertz harmonics. On the other hand, such a combiner will not generally work for a transmitter with a free running oscillator as shown in FIG. 1. In this case, the signal energy does contain 58000 hertz, plus side bands at integer offsets of 90 hertz from the carrier (due to the amplitude modulation of the 90 hertz pulse train). This signal would be heavily attenuated by a 90 hertz comb filter.

An alternate implementation of differentially coherent combining is to lock the receive local oscillator and the transmitter local oscillator in phase and frequency. In this way, the carrier phase roll induced by the transmit oscillator would be exactly cancelled by the phase roll of the receive oscillator.

The performance of the differentially coherent combining detection scheme of the present invention is illustrated as follows. The false alarm probability is again set at $P_{fa}=10^{-8}$. To achieve the same detection probability $P_{det}=0.968$, 14.8 dB SNR is need into the noncoherent detector. If N=4 and receive samples are differentially coherently combined prior to quadrature detection, we get 3.0*log2 N=6.0 dB of processing gain. Therefore, the raw SNR into the receiver need only be 8.8 dB. This is a 3.2 dB improvement over the conventional combining technique. Note the N=4 is used for convenience of the example. In practice N is in the range of 6 to 9. For example, N=8 gives 9 dB of processing gain. On the other hand, optimum noncoherent combining would give only about 5 dB of processing gain. The unanimous vote combiner, which is a suboptimum noncoherent combiner, will be even less. In other words, the performance difference becomes greater the more diversity is used, the more receive samples are combined.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A method for differential coherent combining of received signals in an electronic article surveillance system, comprising:

removing transmitter phase variation from a received signal, said received signal including a first component of an electronic article surveillance tag response and a second component of noise;

filtering said received signal with a plurality of filters each having a preselected bandwidth and a preselected center frequency;

sampling the output of each of said plurality of filters to form a plurality of filtered samples;

combining by diversity averaging each of said plurality of filtered samples; and, quadratically detecting each of said plurality of filtered samples by squaring the diversity combined samples and summing to arrive at a differentially coherent combined signal.

2. The method of claim 1 further comprising comparing said differentially coherent combined signal to a preselected threshold and providing an output signal associated with said comparison.

3. The method of claim 2 wherein a plurality of said differentially coherent combined signals are summed just prior to said comparing to said preselected threshold.

4. The method of claim 1 further comprising discarding any of said plurality of filtered samples that are not relatively close to one another, including discarding all of said filtered samples if none of said filtered samples are relatively close to one another.

5. A system for differential coherent combining of received signals in an electronic article surveillance receiver, comprising:

means for removing transmitter phase variation from a received signal, said received signal including a first component of an electronic article surveillance tag response and a second component of noise;

means for filtering said received signal with a plurality of filters each having a preselected bandwidth and a preselected center frequency;

means for sampling the output of each of said plurality of filters to form a plurality of filtered samples;

means for combining by diversity averaging each of said plurality of filtered samples; and, means for quadratically detecting each of said plurality of filtered samples by squaring the diversity combined samples and summing to arrive at a differentially coherent combined signal.

6. The system of claim 5 further comprising means for comparing said differentially coherent combined signal to a preselected threshold and providing an output signal associated with said comparison.

7. The system of claim 6 further including means for summing a plurality of said differentially coherent combined signals just prior to said comparing means.

8. The system of claim 5 further comprising means for discarding any of said plurality of filtered samples that are not relatively close to one another, including discarding all of said filtered samples if none of said filtered samples are relatively close to one another.

* * * * *